US007853348B2

(12) United States Patent
Weinzierl

(10) Patent No.: US 7,853,348 B2
(45) Date of Patent: Dec. 14, 2010

(54) METHOD FOR PRODUCING A METAL

(75) Inventor: Klaus Weinzierl, Nuremberg (DE)

(73) Assignee: Siemens Aktiengesellschaft, Munich (DE)

( * ) Notice: Subject to any disclaimer, the term of this patent is extended or adjusted under 35 U.S.C. 154(b) by 442 days.

(21) Appl. No.: 11/547,814

(22) PCT Filed: Apr. 6, 2004

(86) PCT No.: PCT/DE2004/000724

§ 371 (c)(1),
(2), (4) Date: Oct. 5, 2006

(87) PCT Pub. No.: WO2005/099923

PCT Pub. Date: Oct. 27, 2005

(65) Prior Publication Data

US 2007/0198122 A1 Aug. 23, 2007

(51) Int. Cl.
*G06F 700/147* (2006.01)

(52) U.S. Cl. ..... 700/147

(58) Field of Classification Search ..... None
See application file for complete search history.

(56) References Cited

U.S. PATENT DOCUMENTS 2,004,006 A 6/1935 Franz et al.
5,891,275 A * 4/1999 Elfmark et al. ..... 148/654
6,860,950 B2 * 3/2005 Franz et al. ..... 148/503
2003/0089431 A1 * 5/2003 Gramckow et al. ..... 148/511
2004/0205951 A1 * 10/2004 Kurz et al. ..... 29/407.05

FOREIGN PATENT DOCUMENTS

| | | | |
|---|---|---|---|
| CN | 1463293 A | | 12/2003 |
| CN | 1463293 | * | 12/2004 |
| DE | 196 39 062 A1 | | 3/1998 |
| DE | 101 29 565 A1 | | 1/2003 |
| WO | WO 03/045599 A1 | | 6/2003 |

* cited by examiner

*Primary Examiner*—Karl J Puttlitz

(57) ABSTRACT

During the production of steel, a conversion model is used for the cooling line. Said model is used to calculate the phase fractions, in addition to the temperature of the steel, along the steel strip in real time. A regulating system, which maintains the phase fractions of a steel strip that is wound onto a reeling device at a constant level, is implemented. The method comprises the following steps: in a first step a degree of conversion, for multi-phase steel e.g. the ferrite fraction, is determined from data obtained from the primary data of the steel strip. In a second step, when the strip enters the cooling line, one or more parameters of the cooling strategy, i.e. control values, are adapted online in such a way that the ferrite content of the cooled steel on the reeling device is maintained at a constant level.

13 Claims, 4 Drawing Sheets

METHOD FOR PRODUCING A METAL

CROSS REFERENCE TO RELATED APPLICATIONS

This application is the US National Stage of International Application No. PCT/DE2004/000724, filed Apr. 6, 2004 and claims the benefit thereof and is incorporated by reference herein in their entirety.

FIELD OF THE INVENTION

The invention relates to a method for producing a metal having a plurality of phase fractions, the hot formed metal being cooled in a cooling line, the temperature and at least one phase fraction of the metal being calculated in a first step in at least one location in the cooling line, using primary data for the metal, by means of a cooling line model. The invention also relates to a calculation means for corresponding control and modeling of a cooling line and to a corresponding unit for producing a metal having a plurality of phase fractions.

BACKGROUND OF THE INVENTION

A cooling method for a hot-rolled stock, in particular a metal strip, is known from DE 101 29 565 A1. In this known method an initial temperature is acquired for a stock location upstream of the cooling line, a coolant quantity characteristic is determined over time using a cooling line model and stipulated desired properties of the stock, a coolant is applied to the stock location according to the coolant quantity characteristic determined over time, an anticipated temperature characteristic over time of the stock at the stock location above the stock cross-section is determined using the cooling line model and the coolant quantity characteristic over time, and to determine the temperature characteristic in the stock in the cooling line model, a heat conduction equation is solved which relates the enthalpy, the thermal conductivity, the degree of phase conversion, the density and the temperature of the stock to each other. In the method described in DE 101 29 565 A1 anticipated temperature characteristics of the metal strip are compared with target temperature characteristics. A new coolant quantity characteristic is calculated on the basis of this comparison.

Hot formed metals produced and cooled according to known methods frequently do not satisfy, or do not satisfy with adequate reliability, the properties or material properties required for subsequent use thereof.

SUMMARY OF THE INVENTION

The object of the invention is to enable production of metal with high quality material properties, with the required properties or material properties of the metal being as precisely adhered to as possible.

This object is achieved by a method of the type mentioned in the introduction in which, in a second step, at least one temperature measured value is acquired during production of the metal, and using the at least one temperature measured value, at least one anticipated phase fraction of the metal is calculated by means of the cooling line model at the at least one location in the cooling line, the anticipated phase fraction calculated in the second step being compared with the phase fraction calculated in the first step and this comparison being used to adjust at least one correcting variable of the cooling line.

In this manner the phase fractions at the end of the cooling line can be kept substantially constant, viewed by way of the metal, even with varying production conditions during production of the metal. By adjusting at least one correcting variable of the cooling line differences between different strips with the same primary data are also substantially eliminated. In the first step, the at least one phase fraction is calculated in such a way that the variations in the unit do not enter into the calculation, i.e. a reference degree of conversion is determined. In the second step control is to this reference degree of conversion, with the actual variations in the unit being substantially compensated by adjustment of local cooling line correcting variables. A consistent quality may be ensured significantly better when producing metal according to the invention than with known methods.

To further improve the accuracy of the method according to the invention and to keep the phase fractions at the end of the cooling line constant in an even more reliable manner, it is expedient for the at least one location at which at least one phase fraction of the metal is calculated in the first and second steps of the method, to be located at the end of the cooling line.

Alternatively the anticipated phase fraction calculated in the second step is advantageously compared in the second step with a stipulated phase fraction. In this case it is no longer necessary to compare the anticipated phase fraction calculated in the second step with the phase fraction calculated in the first step. Direct stipulations of an operator for example when setting the phase fraction are taken into account in this way.

The second step is advantageously iteratively executed online, i.e. in real time, during production of the metal. By repeating the second step, i.e. repeated measured value acquisition, calculation, comparison and optionally adjustment, the accuracy of the method is improved further.

In the second step at least one correcting variable of the cooling line is advantageously adjusted in accordance with the comparison by a cooling line controller. The cooling line controller directly adjusts the correcting variables of the cooling line on the basis of the comparison of the phase fractions according to the calculations from the first or second step. High control accuracy is thus ensured.

Alternatively a cascaded control structure is provided with the cooling line controller being provided with target values from a superimposed phase fraction controller. In the process the phase fraction controller, in the second step, adjusts at least one target value for the cooling line controller and the cooling line controller adjusts at least one correcting variable of the cooling line by taking into account target values with which it has been provided.

A temperature model is advantageously used in at least one of the two steps, which model calculates the temperature characteristic of the metal in the cooling line. Particularly high control accuracy is thus attained with respect to the temperature of the metal.

The temperature model is advantageously adapted using the at least one measured value. Variations in the production of the metal may be compensated even more effectively in this way.

To improve the control accuracy with respect to the phase fractions, a conversion model is preferably used which calculates the characteristic of the at least one phase fraction in the cooling line.

A multi-phase steel is advantageously produced. It is precisely in multi-phase steels, such as dual phase steels or TRIP steels, that keeping the phase fractions, and thus the degree of conversion, constant in the cooling line is particularly critical and important. These steels have particularly good material properties, for example for the automotive industry.

The metal is advantageously cooled in the cooling line in at least two cooling sections. Desired phase fractions, in particular in the case of multi-phase steels, may be purposefully adjusted in this way.

A holding time is preferably adjusted.

A holding temperature is preferably adjusted. With cooling in a plurality of cooling sections, variables, such as holding time and holding temperature, are particularly critical for the phase fractions in metal.

At least one correcting variable is advantageously adjusted for coolant actuators. Coolant actuators are local actuators in the cooling line and therefore have for example no effects on a finishing train arranged upstream of the cooling line. The finishing train is thus not undesirably affected by the adjustment of the correcting variables for the coolant actuators.

When producing sheet steel at least one correcting variable is advantageously adjusted for the speed of the metal in the cooling line. When producing sheet steel the speed of the metal in the cooling line can substantially be influenced independently of the speed at which the metal passes through unit components arranged upstream of the cooling line.

When producing sheet steel at least one correcting variable is advantageously adjusted for an idle time of the metal. When producing sheet steel the storage time of the metal is a further local correcting variable for setting the phase fractions of the metal.

The object underlying the invention is also achieved by a calculation means as claimed in the claims.

The invention is also achieved by a unit for producing a metal, comprising a cooling line and comprising a calculation means of this type, the calculation means being coupled via correspondingly configured interfaces to signal transmitters and actuators of the cooling line to control and model the cooling line.

The invention is also achieved by a metal according to the claims. Particularly uniform material properties in the metal result.

The advantages with respect to the calculation means, the unit and the metal result analogously to the advantages of the method.

BRIEF DESCRIPTION OF THE DRAWINGS

Further advantages and details emerge from the following description of embodiments in conjunction with the drawings, in which in a basic diagram.

DETAILED DESCRIPTION OF THE INVENTION

Figure 1:
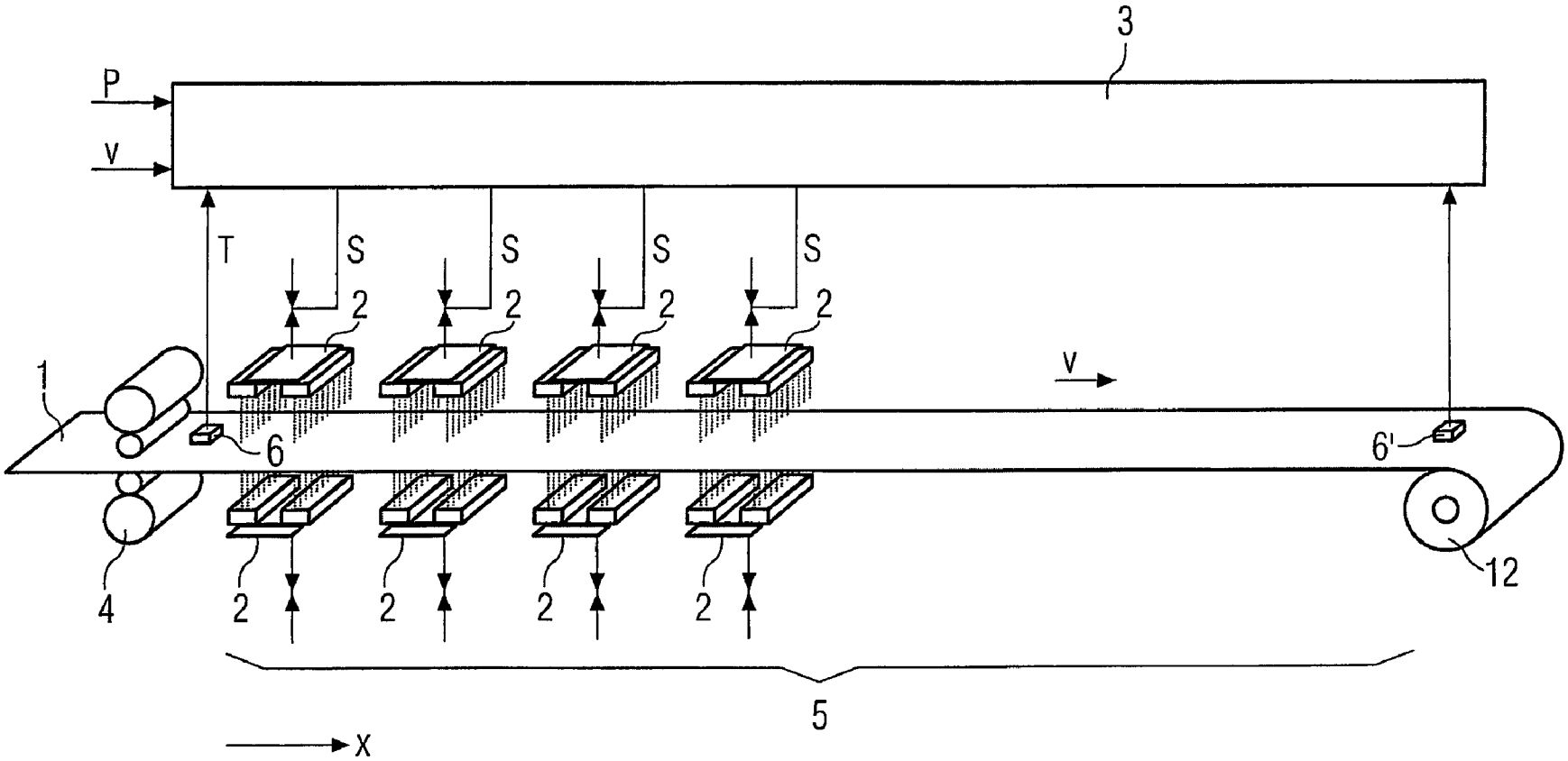
FIG. 1 shows a cooling line.

FIG. 1 shows a cooling line 5 and a calculation means 3 for controlling or regulating and modeling the cooling line 5. In the illustrated example a hot formed metal 1 exits a rolling stand 4 in the running direction x of the strip at a speed v. The rolling stand 4 is for example the last rolling stand of what is known as a finishing train. A different forming or working device for the metal 1 may however be arranged upstream of the cooling line 5. The cooling line 5 and any one or more device(s) arranged upstream of it for forming or working the metal 1 and any devices arranged downstream of the cooling line 5 form a unit for producing a metal 1. In the illustrated example a winding device 12 is arranged downstream of the cooling line 5, with the aid of which device the cooled metal 1 is wound to form a coil. Other devices, not shown in the drawings, for processing and/or storing the metal 1 may however also be arranged downstream of the cooling line 5.

In this case the metal 1 is solid steel. It could however also be at least partially liquid. According to FIG. 1 the metal 1 is formed as a metal strip or slab. However other forms of the metal 1, for example rod-shaped profiles, such as wires, pipes or U-profiles, are also conceivable.

To influence the temperature of the metal 1 the cooling line 5 comprises one or more actuator(s) 2. The temperature T of the metal 1 can be directly or indirectly influenced by means of the actuator 2, usually by cooling, but in individual cases also by heating. An actuator 2 can for example comprise one or more valve(s) for applying a coolant to the metal 1. Water or a mixture of water with other substances can be used as the coolant. The cooling line 5 is controlled by the calculation means 3. The actuator 2 is in particular also controlled by the calculation means 3 according to a correcting variable S. Measuring components 6, 6' are provided by means of which the temperature T of the metal 1 is acquired. At the start of the cooling line, downstream of the final rolling stand 4 in the illustrated example, there is arranged a first measuring component 6 for recording temperature. A further measuring component 6' for recording temperature is arranged at the end of the cooling line 5 or, in the illustrated example, upstream of the winding device 12.

The calculation means 3 provides the cooling line actuators 2 with correcting variables S. Measured values, such as the temperature T of the cooling line 5 and/or of devices arranged upstream or downstream of the cooling line, are fed to the calculation means 3. The calculation means 3 may also be provided with the actual speed v of the metal 1. The actual speed v of the metal can be determined by measuring and/or using at least one model. The calculation means 3 can for example also be provided with the rotational speeds of the rollers of a rolling stand 4, as measured values and/or calculated or modeled values. The calculation means 3 is also provided with what is referred to as primary data P. Primary data P is generally used to calculate in advance or pre-set a unit and is dependent on the metal 1 to be produced. Different metal strips or slabs are usually characterized by different primary data. Primary data can also be at least partially based on the required properties of the metal 1 produced.

Figure 2:
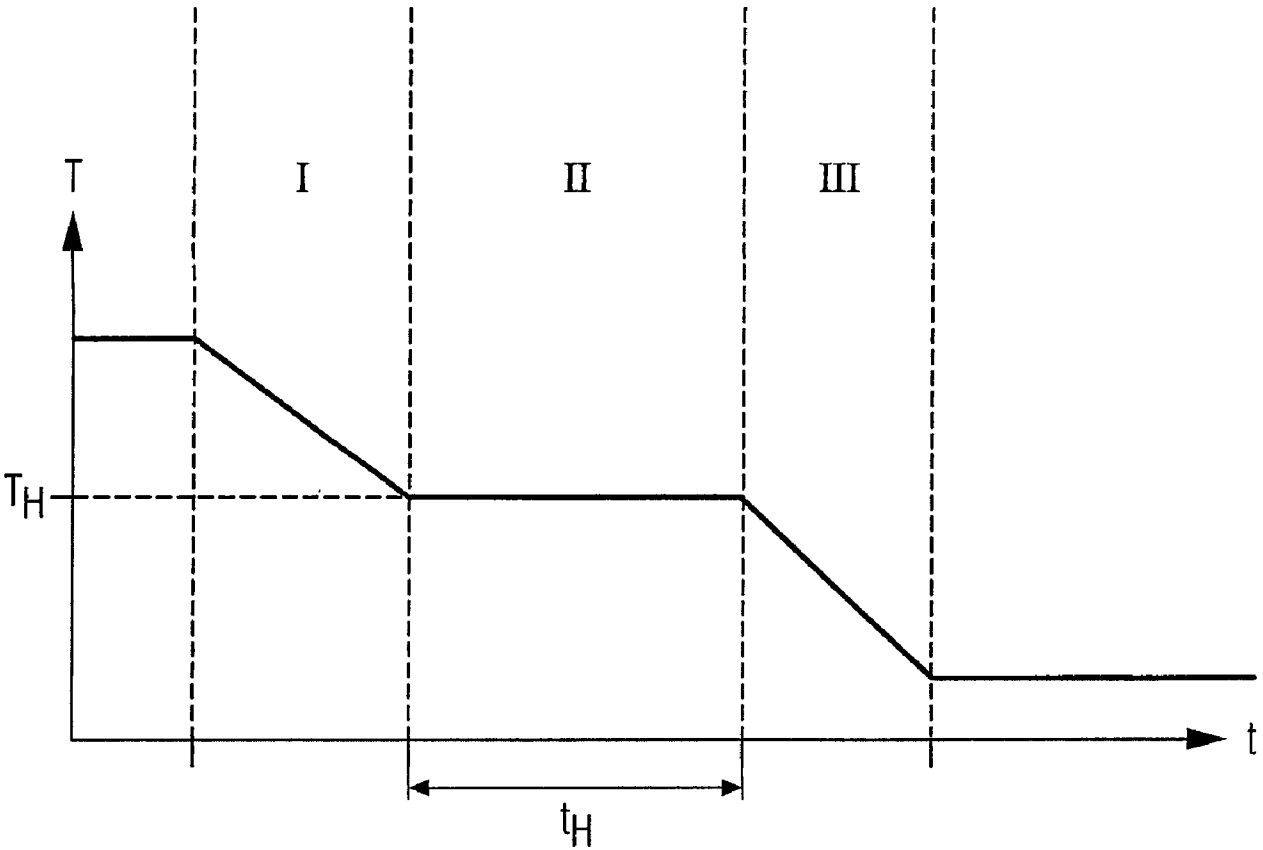
FIG. 2 shows a temperature characteristic.

FIG. 2 shows the characteristic of the temperature T of the metal 1 in the cooling line 5 plotted over time t. The time t is based in this case on the time during which a point in the metal 1, in the form of a strip according to FIG. 1, passes through the cooling line 5.

Alternatively the temperature T could also be plotted over the running direction x of the strip, in other words the position in the cooling line. The temperature T is used in its property as a variable that describes the energy content of the metal 1. The characteristic of the enthalpy over time t or over the running direction x of the strip could therefore also be seen as an alternative.

Crucial to the material properties of the metal 1 or steel produced are the phase fractions $P_i$ at the end of the cooling line 5 or at the winding device 12. Particularly crucial, but also critical during production, are the phase fractions $P_i$ of a metal 1, in particular in the case of multi-phase steels, such as dual phase and TRIP steels. With steels of this kind a conventional cooling method is cooling divided into three cooling sections. In this case the metal 1 is cooled in the cooling line 5 in a plurality of temporal cooling phases or temporal cooling sections I, II, III. The temporal cooling sections I, II, III can, but do not have to, coincide with physical or component-based cooling sections. In the first cooling section I, or in the first cooling phase, the metal 1 is preferably cooled at a high cooling rate to a holding temperature $T_H$. The holding temperature $T_H$ is usually stipulated or dependent on the primary data. Air cooling with a stipulated holding time $t_H$ takes place in a second cooling section II. In the second cooling section II the temperature T of the metal 1 or the steel decreases only slightly. Quenching of the metal 1 to temperature T or below the temperature T which is to be attained at the end of the cooling line or immediately before winding by means of the winding device 12, then takes place in a third cooling section III. The metal 1 is preferably quenched below the initial martensite temperature.

To obtain a structure with a phase fraction $P_i$ of approx. 80% ferrite and a phase fraction $P_i$ of approx. 20% martensite or bainite for example in dual phase steels, a retained austenite content of typically 20% is conventionally desired before the start of quenching. With TRIP steels a retained austenite content that is metastable at ambient temperature and which is converted into martensite when shaped also remains.

Both dual phase steels and TRIP steels may be shaped initially with low force expenditure during subsequent use thereof. As shaping increases the rigidity increases as well however, with this behavior being even more pronounced in TRIP steels than in dual phase steels. Typical applications of dual and TRIP steels are body sheets and wheel rims for motor vehicles, where good deep drawing properties, high end strength and high energy absorption capacities are required in the case of further deformation, for example as a result of accidents.

When producing these steels keeping the phase fractions $P_i$, and therefore the degree of conversion, in the cooling line 5 constant is extremely critical. If, for example, in a hot rolling mill arranged upstream of the cooling line 5 undesirable surface temperature impairments, such as what are referred to as skid marks, are generated on the metal 1, steel slabs in this case, these undesirable skid marks lead to weak points in the metal strip. At such weak points the degree of conversion in the metal 1 has already progressed too far before quenching has begun to form sufficient martensite or bainite. Other variations in the process parameters in the devices arranged upstream of the cooling line 5 can cause further differences from the desired structure and the desired phase fractions $P_i$ in the metal 1.

Figure 3:
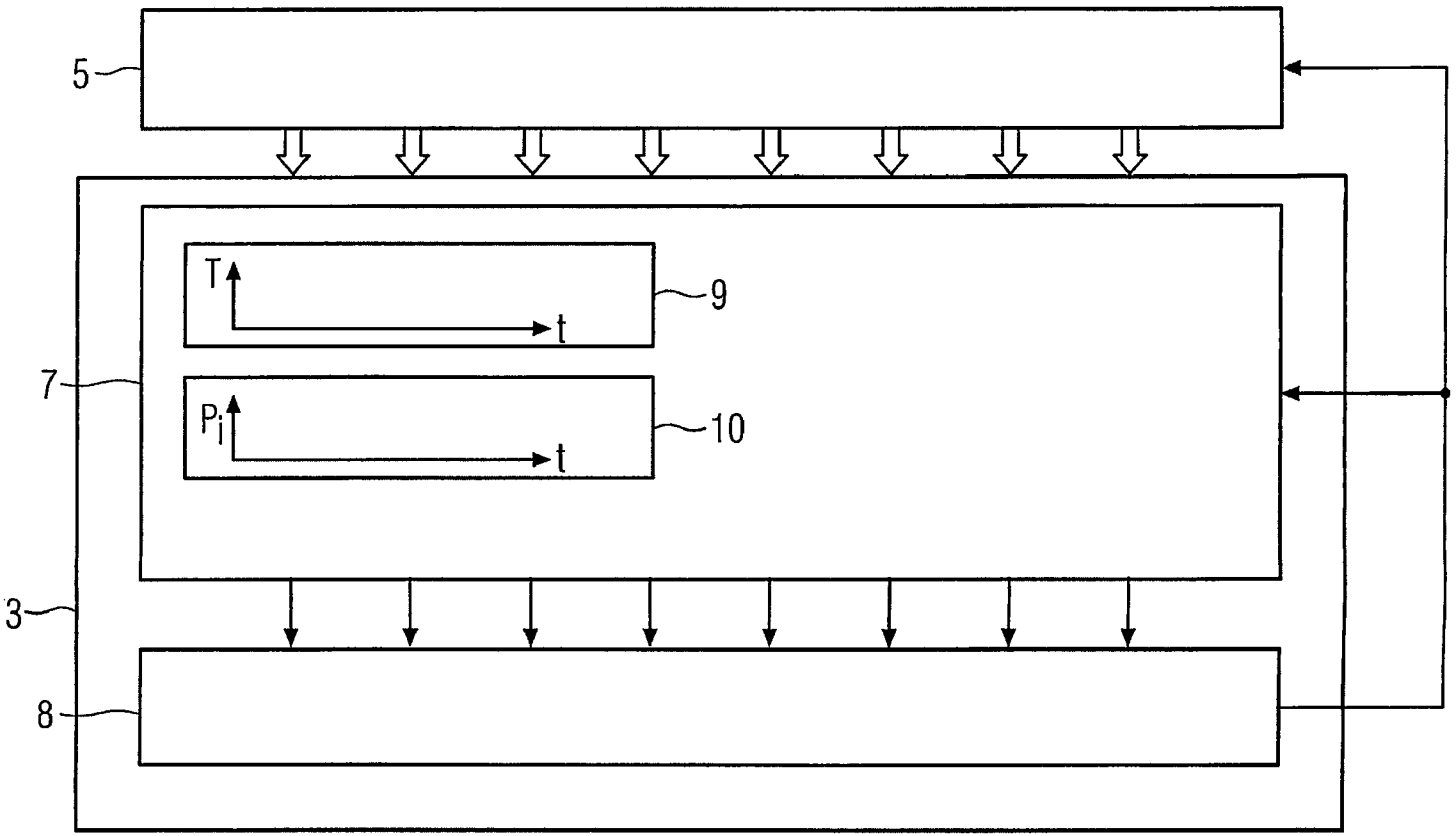
FIG. 3 shows a simple control system for the cooling line.
Figure 4:
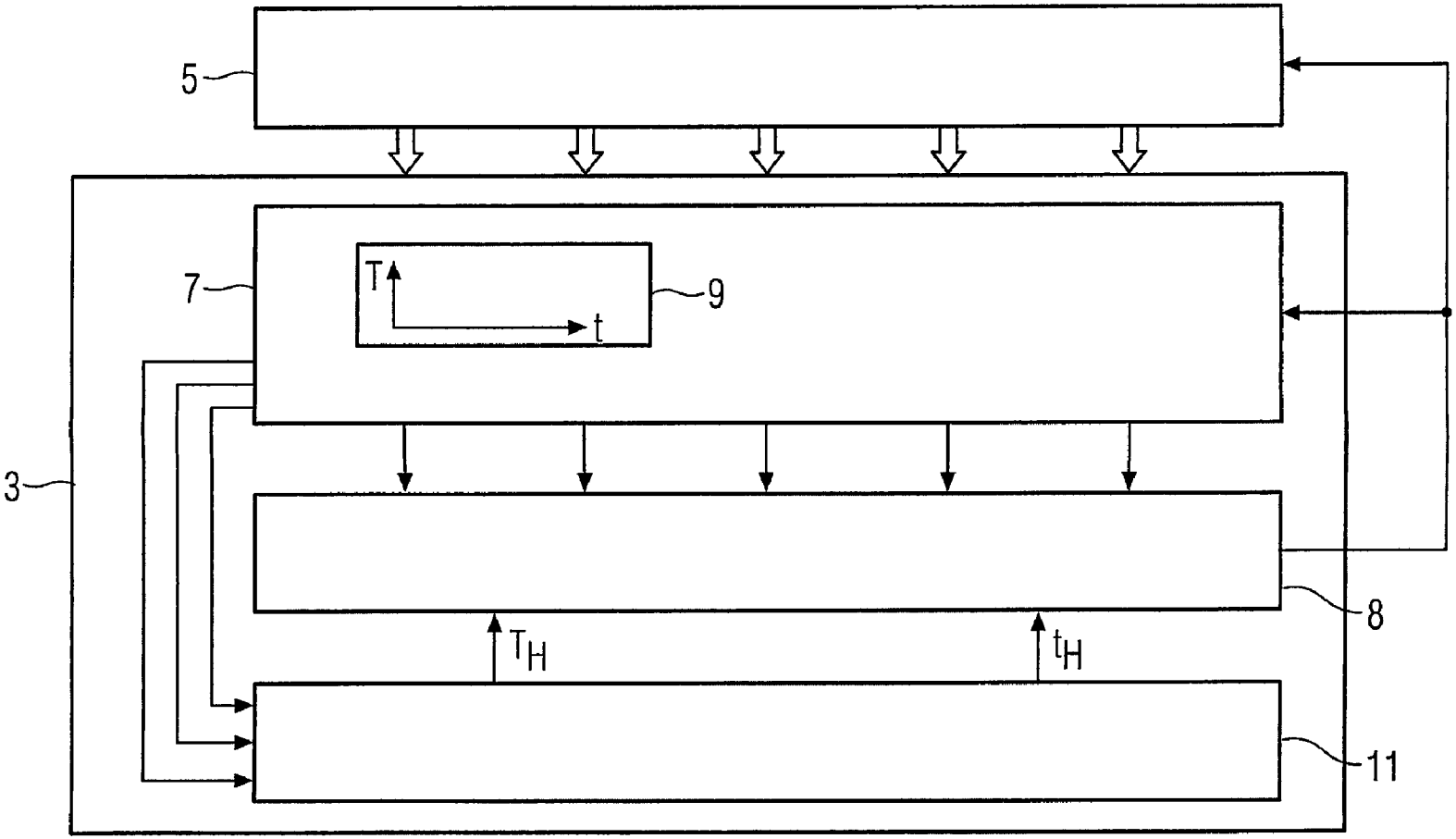
FIG. 4 shows a cascaded control system for the cooling line.

FIGS. 3 and 4 show control systems according to the invention for the cooling line 5. Both figures show a calculation means 3 coupled to the cooling line 5 for controlling and modeling the cooling line 5. Interfaces are provided to supply the calculation means 3 with signals for modeling and to supply the cooling line 5 with control or regulating signals. Calculation means 3 and cooling line 5 form part of a unit for producing a metal 1.

According to FIG. 3 the calculation means 3 comprises a cooling line model 7 and a cooling line controller 8. For a metal 1, for example a metal strip made of steel, which passes into the cooling line 5 the temperature T and at least one phase fraction $P_i$ at the end of the cooling line 5 or upstream of the winding device 12 are calculated in a first step using the cooling line model 7 and based on the primary data P for the metal strip. Using measuring components which may for example be arranged in a finishing train arranged upstream of the cooling line 5 (not shown in the drawings), and/or using a measuring component 6 at the entrance to the cooling line 5, measured values are acquired in a second step and supplied to the calculation means 3. The measured values are acquired as the metal 1 passes through the unit for producing a metal 1.

By using the measured value(s) the cooling line model 7 determines, at least at the end of the cooling line 5, at least one anticipated phase fraction $P_i$ of the metal 1. The anticipated phase fraction $P_i$ calculated in the second step is compared with the phase fraction $P_i$ calculated in the first step on the basis of the primary data P. This comparison is used for adjusting at least one correcting variable S of the cooling line 5. According to FIG. 3 the cooling line controller 8 adjusts at least one correcting variable S of the cooling line 5. A relatively simple way of producing a cooling line controller of this type is for the correcting variables S of actuators 2 to preferably be adjusted at the end of the first cooling section I.

According to FIG. 4 the calculation means 3 comprises a cooling line model 7, a cooling line controller 8 and a phase fraction controller 11. In terms of control engineering the phase fraction controller 11 is superimposed on the cooling line controller 8. The phase fraction controller 11 thus provides the cooling line controller 8 with at least one target value, for example $T_H$ or $t_H$, on the basis of the comparison of the phase fraction $P_i$ calculated in the first step and the anticipated phase fraction $P_i$ calculated in the second step. With a cooling sequence with a plurality of cooling sections I, II, III or cooling phases, as is shown for example in FIG. 2, the phase fraction controller 11 preferably provides the cooling line controller 8 with a holding time $t_H$ and/or a holding temperature $T_H$. The cooling line controller 8 adjusts the correcting variables S of the cooling line 5, and takes the target presets of the phase fraction controller 11 into account in the process.

Both control systems, i.e. both the control system according to FIG. 3 and the control system according to FIG. 4, preferably operate in such a way that the second step is iteratively executed online, i.e. in real time, during production of the metal 1.

The phase fraction $P_i$ is calculated in the same way in both the first and second steps, i.e. using the same computing methods or models. Calculation in the two steps differs however with respect to the data underlying the calculation, in particular with respect to the input data for the calculation.

As an alternative to the phase fraction $P_i$ calculated on the basis of the primary data P in the first step, a phase fraction $P_i$ stipulated by an operator for example in a first step can also be compared in the second step with the anticipated phase fraction $P_i$ calculated in the second step. To ensure consistently high quality of the metal 1 at the end of the cooling line 5, at least one phase fraction $P_i$ of the metal 1 is calculated at the end of the cooling line.

As an alternative, or additionally, at least one phase fraction $P_i$ of the metal can be calculated in at least one other location in the cooling line 5. If, for example, it is not expedient to measure at the end of the cooling line 5, at least one phase fraction $P_i$ of the metal can be calculated in both the first and second steps of the method at a different location in the cooling line 5, for example at a location at which it is assumed that the fundamental part of the phase conversion within the cooling line 5 has already finished.

The calculation means 3 and the cooling line model 7 preferably comprise a temperature model 9 which calculates the temperature characteristic of the metal 1 in the cooling line 5 over time t or over the running direction x of the strip. The temperature model 9 is advantageously adapted using at least one measured value. The at least one measured value is preferably a measured value for the temperature T of the metal 1 which is acquired by means of a measuring component 6, 6' at the entrance to or exit from the cooling line 5. The measured value may alternatively or additionally be acquired at a different cooling line 5 location. A conversion model 10 is preferably provided which calculates the characteristic of the at least one phase fraction $P_i$ of the metal 1 in the cooling line 5 over time t and/or the running direction x of the strip. As an alternative or in addition to temperature T, the cooling line model 7 and/or the temperature model 9 may also use or calculate the enthalpy or a different energy content-describing variable.

While a conversion model 10 is not shown in FIG. 4 for the sake of clarity, it is expedient in the embodiment according to FIG. 4. A conversion model 10 must provide at least the phase fraction $P_i$ of the metal 1 in at least one cooling line 5 location, preferably at the end of the cooling line 5.

The position of valves for example for coolants or the flow of coolant in the cooling line 5 is controlled via the correcting variables S for the actuators 2 of the cooling line 5. Local correcting variables S of this kind, i.e. correcting variables which do not have any effect on the unit components arranged upstream of the cooling line 5, may however, when producing steel plate, also be the speed v of the metal 1 in the cooling line and an idle time of the metal 1.

The inventive idea may substantially be summarized as follows:

When producing steel a conversion model 10 is used for the cooling line 5, with the aid of which the phase fractions $P_i$ along the strip of steel may be calculated in real time in addition to the temperature T of the steel. A control system is implemented which keeps the phase fractions $P_i$ of the steel strip wound on a winding device 12 constant. For this purpose the following steps are carried out: the degree of conversion, for example the ferrite content in multi-phase steels, is determined in a first step from data, which is given by the primary data P of the steel strip. In a second step, as the strip enters the cooling line 5, one or more parameter(s) of the cooling strategy, i.e. correcting variables S, are adapted online in the sense of a control in such a way that the ferrite content of the cooled steel at the winding device 1 is kept constant. In the case of cooling featuring a plurality of cooling sections, the holding temperature $T_H$ may be modified for this purpose. Elevation of the holding temperature $T_H$ reduces the ferrite content; reduction of the holding temperature $T_H$ increases it.

Deviations from the target structure are already discovered online according to the inventive method and not only after measurements of the structural fractions in the laboratory (sections) or in tension tests.

With known methods the constancy of the structural fractions along the strip is conventionally assessed by quality assurance in the steel works using only the temperature record for intermediate temperature and winder temperature. The method according to the invention on the other hand allows the phase fractions $P_i$ at the winding device 12 to be kept substantially constant along the metal strip, even with variations in production conditions and varying speed v of the metal strip. Differences between various metal strips with the same primary data P are largely eliminated because the variations in the unit do not enter the first determination of the reference degree of conversion and the variations in the unit are largely compensated by subsequent control to the reference degree of conversion. First determination of the reference degree of conversion or at least one phase fraction $P_i$ depends only on the primary data P. Subsequent determinations of the degree of conversion or a phase fraction $P_i$ take account of the variations during production. Steel or metal 1 of consistent quality may hence be produced and the requirements placed on the material properties of the metal 1 or the steel are satisfied much more reliably than before.

The invention claimed is:

1. A method for producing a hot formed metal having a plurality of phase fractions, comprising:

cooling the metal by a cooling line;

calculating a temperature and a first phase fraction of the metal at the end of the cooling line by a cooling line model that utilizes a primary data of the metal;

acquiring a temperature value of the metal during production at a second location using temperature measuring components;

calculating an anticipated phase fraction of the metal at the end of the cooling line via the cooling line model based on the acquired temperature value;

comparing the calculated first phase fraction with the anticipated phase fraction; and adjusting a correcting variable of the cooling line based on the comparison, wherein the second location is upstream of the end of the cooling line, and wherein adjusting a correcting variable adjusts cooling of the metal downstream of the second location.

2. The method as claimed in claim 1, wherein the anticipated phase fraction is compared with a predetermined phase fraction.

3. The method as claimed in claim 1, wherein the metal temperature is acquired, the anticipated phase fraction is calculated, the comparison and the adjustment are iteratively performed online.

4. The method as claimed in claim 1, wherein a cooling line controller adjusts the correcting variable based on the comparison.

5. The method as claimed in claim 4, wherein:

a phase fraction controller adjust a target value for a cooling line controller based on the comparison, and the cooling line controller adjusts a correcting variable of the cooling line based on the target values.

6. The method as claimed in claim 5, further comprising calculating a temperature characteristic of the metal via a temperature model.

7. The method as claimed in claim 6, wherein the temperature model receives a measured value as an input.

8. The method as claimed in claim 7, wherein a conversion model calculates a characteristic of the phase fraction in the cooling line.

9. The method as claimed in claim 8, wherein a multi-phase steel is produced.

10. The method as claimed in claim 9, wherein the metal is cooled along the cooling line in a plurality of cooling sections.

11. The method as claimed in claim 10, wherein a correcting variable is adjusted that represents factors selected from the group consisting of: coolant actuators, speed of the metal in the cooling line, and an idle time of the metal.

12. The method as claimed in claim 10, wherein a holding time is adjusted.

13. The method as claimed in claim 12, wherein a holding temperature is adjusted.

* * * * *